United States Patent [19]

Mattick et al.

[11] Patent Number: 5,005,322

[45] **Date of Patent: * Apr. 9, 1991**

[54] INFLATABLE TENT STRUCTURE

[75] Inventors: Michael J. Mattick; John W. Huffman, both of Charlotte, N.C.

[73] Assignee: Pneumo-Beam International, Ltd., Charlotte, N.C.

[ * ] Notice: The portion of the term of this patent subsequent to Oct. 31, 2006 has been disclaimed.

[21] Appl. No.: 428,765

[22] Filed: Oct. 30, 1989

Related U.S. Application Data

[63] Continuation-in-part of Ser. No. 145,051, Jan. 19, 1988, Pat. No. 4,876,829.

[51] Int. Cl.[5] ..... E04B 1/34

[52] U.S. Cl. ..... 52/2 J

[58] Field of Search ..... 52/2 J; 135/100, 102, 135/104, 119, DIG. 9

[56] References Cited

FOREIGN PATENT DOCUMENTS

W086/00952 2/1986 .

OTHER PUBLICATIONS

"New Leisure Good Camping", See Tabbed Page.

*Primary Examiner*—David A. Scherbel
*Assistant Examiner*—Creighton Smith
*Attorney, Agent, or Firm*—W. Thad Adams, III

[57] ABSTRACT

A tent formed of a plurality of mechanically interconnected but pneumatically separate, elongate inflatable tubes defining the perimeter of the tent structure for being separately inflated and a plurality of valves pneumatically connected to respective separately-inflatable tube for inflating the tubes. A plurality of wall panels are suspended from and between the tubes to define the enclosure of the tent whereby the tubes define a support structure exterior to the enclosure of the tent.

12 Claims, 5 Drawing Sheets

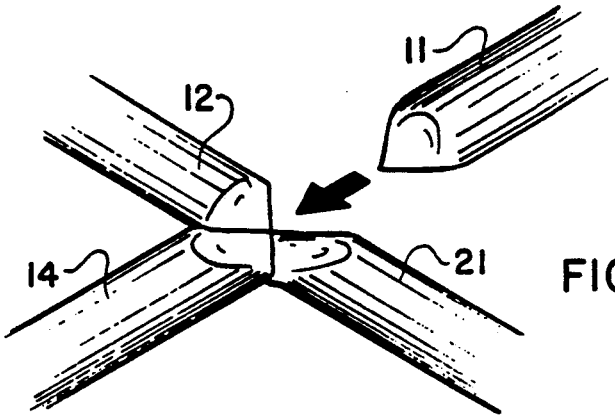
FIG. 3
FIG. 4
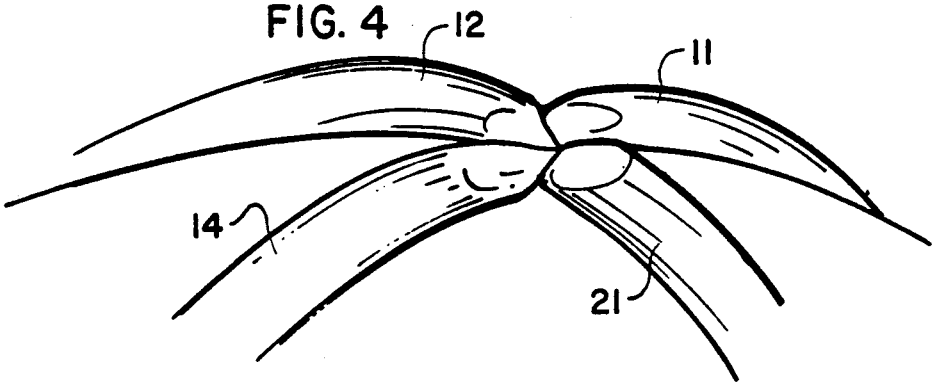
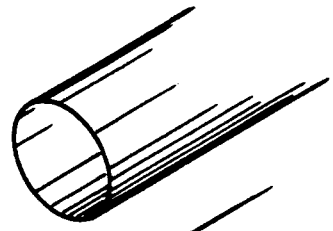
FIG. 5
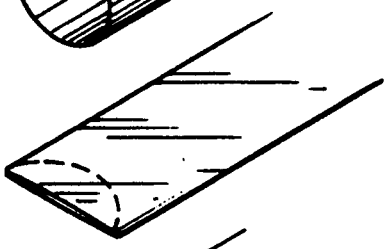
FIG. 5A
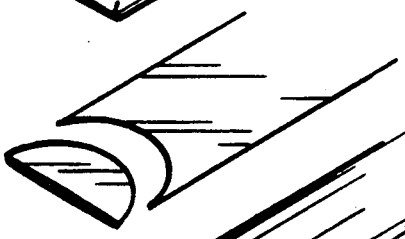
FIG. 5B
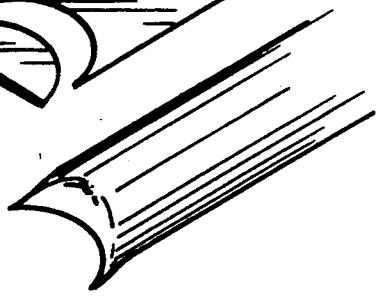
FIG. 5C

INFLATABLE TENT STRUCTURE

TECHNICAL FIELD AND BACKGROUND OF THE INVENTION

This application is a continuation-in-part of application Ser. No. 145,051, filed on Jan. 19, 1988, now U.S. Pat. No. 4,876,829.

This invention relates to an inflatable tent structure, the design of which permits the tent to be easily erected, collapsed and stored. The design of the tent also permits the structure to be easily manufactured with a minimum of parts and fabrication. Nevertheless, the structure is sturdy, weather resistent and provides safe and comfortable shelter.

The tent is characterized by the placement of the perimeter of the tent structure completely exterior to the interior of the tent as defined by the tent walls. This provides easy access to the inflated structure for ease of repair and more uninterrupted space for the occupants. The tent is also characterized by an inflated structure composed of relatively short, individually inflated "beams" which provide substantial rigidity to the tent.

SUMMARY OF THE INVENTION

Therefore, it is an object of the invention to provide an inflatable tent structure which is inexpensive to manufacture and maintain.

It is another object of the invention to provide an inflatable tent structure which is easy to erect, collapse and store.

It is another object of the invention to provide an inflatable tent structure which can be inflated with a simple low pressure air pump.

It is another object of the invention to provide an inflatable tent structure which provides inexpensive shelter on a temporary or emergency basis on short notice.

It is still another object of the invention to provide an inflatable tent structure which has no sharp or rigid components so the tent can be dropped from an aircraft or helicopter to the ground in rescue and disaster situations.

It is another object of the invention to provide an inflatable tent structure with separately inflatable tubes which intersect in the same plane.

These and other objects of the present invention are achieved in the preferred embodiments disclosed below by providing a tent formed of a plurality of mechanically interconnected but pneumatically separate, elongate inflatable tubes defining the perimeter of the tent structure for being separately inflated and a plurality of valves pneumatically connected to respective separately-inflatable tube for inflating the tubes. A plurality of wall panels are suspended from and between the tubes to define the enclosure of the tent whereby the tubes define a support structure exterior to the enclosure of the tent.

According to one preferred embodiment of the invention, the tubes define a dome-shaped structure having an apex, the tubes converging in mechanical interconnection with each other in a single plane at the apex of the dome-shaped structure.

According to another preferred embodiment of the invention, at least some of the tubes have through passages therein, and other of the tubes extend through the tubes in the same plane as the tubes.

According to yet another preferred embodiment of the invention, the valves include connection means for interconnection with an air pump.

Preferably, the tubes include an interiorly projecting flange to which the wall panels are attached in spaced-apart relation.

According to another preferred embodiment of the invention, the flange is formed from a material different from that which the tubes are formed.

Preferably, the tent comprises a plurality of substantially vertically-extending tubes and a plurality of substantially horizontally-extending tubes mechanically intersecting the vertically-extending tubes in the same plane as the vertically-extending tubes.

According to another preferred embodiment of the invention, the tent comprises a plurality of substantially vertically-extending tubes and a plurality of substantially horizontally-extending tubes mechanically intersecting the vertically-extending tubes in the same plane as the vertically-extending tubes, wherein the vertically-extending tubes and the horizontally-extending tubes include separation means for pneumatically separating the tubes at each intersection.

According to yet another preferred embodiment of the invention, including mechanical attachment means for interconnecting the substantially vertically-extending tubes at the apex of the tent.

According to one preferred embodiment of the invention, the mechanical attachment means comprises fabric attached by opposing edges to opposing vertically-extending tubes.

Preferably, the mechanical attachment means comprises elongate bars attached by opposing ends to opposing vertically-extending tubes.

BRIEF DESCRIPTION OF THE DRAWINGS

Some of the objects of the invention have been set forth above. Other objects and advantages of the invention will appear as the description of the invention proceeds when taken in conjunction with following drawings, in which:

Figs. 3 and 4 illustrate joinder of the tubes at the apex of the tent according to one embodiment of the invention;

FIGS. 5A, 5B and 5C illustrate fabrication of the tubes in preparation for joinder of intersecting vertical and horizontal tubes;

DESCRIPTION OF THE PREFERRED EMBODIMENT

Figure 1:
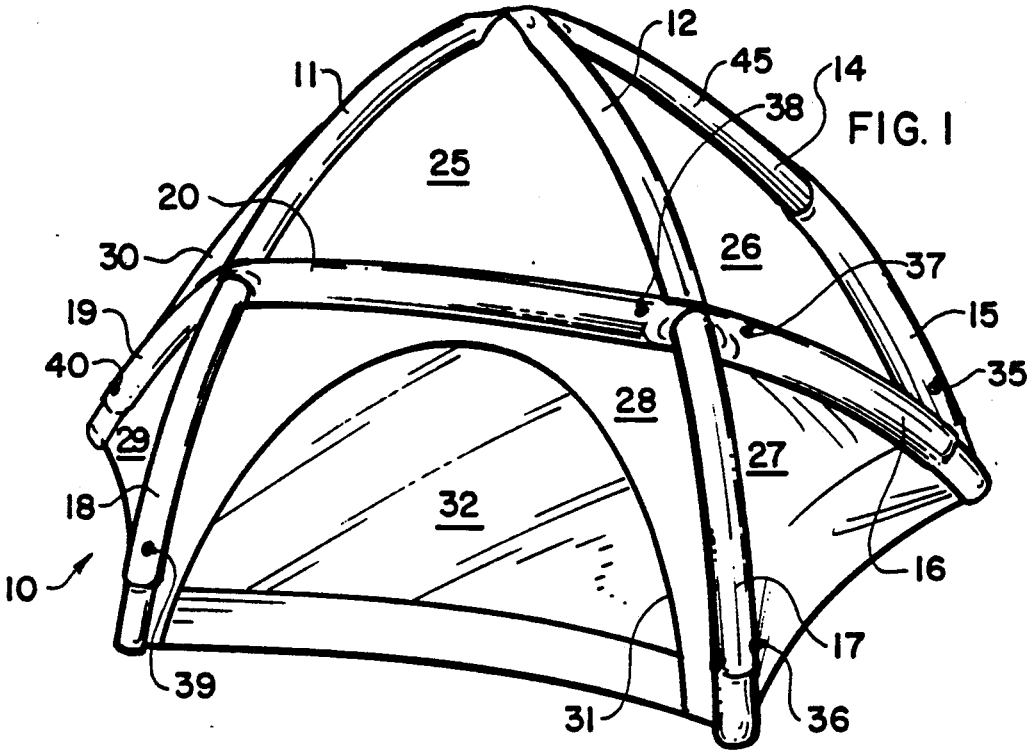
FIG. 1 is a perspective view of one embodiment of the invention.

Referring now specifically to the drawings, a tent according to one embodiment of the present invention is illustrated in FIG. 1 and shown generally at reference numeral 10. The tent 10 is constructed of interconnected tubes 11–21, inclusive, together with other tubes (not shown) on the back side of the tent which are configured as shown in FIGS. 1 and 3. These tubes collectively define a dome-shaped support structure from which six wall panels 25–30 are suspended. Again, other wall panels (not shown) on the back side of the tent are configured as shown in FIG. 1. Wall panel 28 includes a entrance 31 covered by a removable fabric cover 32. Wall panels 25–30 are constructed of a breathable fabric material selected according to the anticipated climate within which the tent 10 will likely be used. Tubes 11–21 are fabricated from a rubberized fabric or a thermoplastic sheet material such as a polyurethane coated nylon having a wall structure of sufficient density to resist passage of air under pressure.

Tubes 11–21 are inflated by means of inflation valves 35–40 positioned on each of the tubes as is best shown in FIG. 1. Valves 35–40 permit connection with a source of air, such as a small air compressor of the type operated off of a car battery or a foot operated manual pump.

In the embodiment shown in FIG. 1, the vertical tubes 11, 12, and 14 and other vertical tubes each comprise a single unitary, inflatable structure with a single valve for each tube. Horizontal and diagonally-extending tubes 15, 16, 18 and 19 each have their own valve and are separately inflatable.

Figure 10:
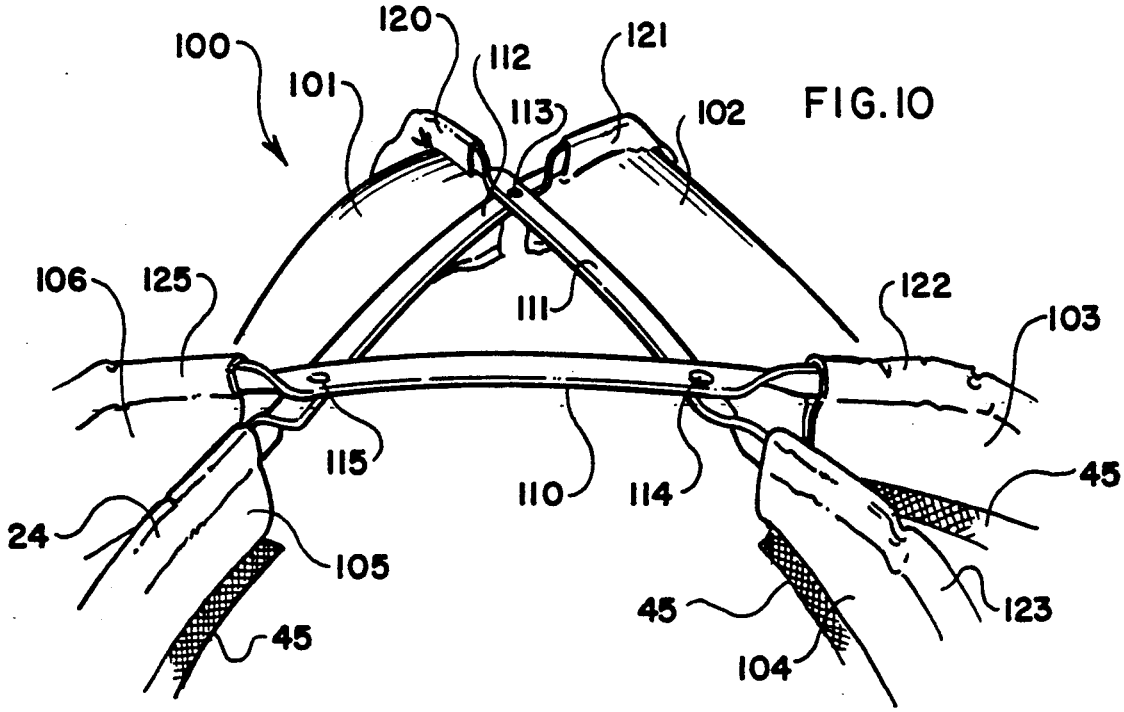
FIG. 10 is a fragmentary perspective view of the apex of a tent according to still another embodiment of the invention.

Wall panels 25–30 are suspended beneath and between tubes 11–21 by means of flanges 45 formed on the bottom of each of the tubes 11–21. As is best shown in FIG. 10, flange 40 is formed by adhering together adjacent material separate from that of the tube and heat welding or cementing the adjacent walls together along both the length and width of the flange 45. The tubes and the adjacent wall panels are connected together by stitching the adjacent edges of the flange 45 and the wall panels together. Thereafter, the entire stitched structure may be overtaped to further secure the seam and to provide a neater looking joint.

A floor, including an air mattress (not shown) may be incorporated into the structure of the tent 10 and may be integrated into the structure so that the mattress inflates along with the tubes 11–21, or so that it is separately inflatable. The tent 10 can be secured to the ground with pegs or spikes attached to a loop on the bottom of each of the vertical tubes 11, 12, 14 and 21.

Figure 2:
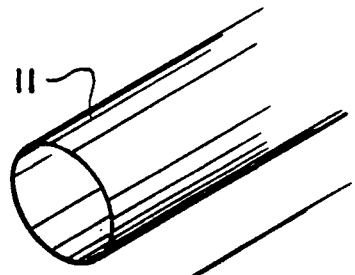
FIGS. 2, 2A, 2B and 2C illustrate fabrication of the tubes in preparation for joinder the apex of the tent.
Figure 2A:
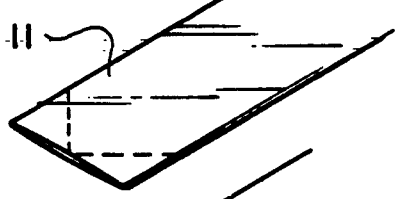
Figure 2B:
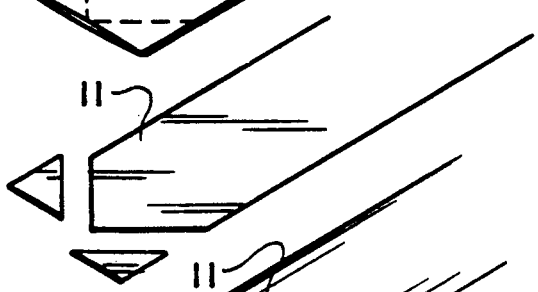
Figure 2C:
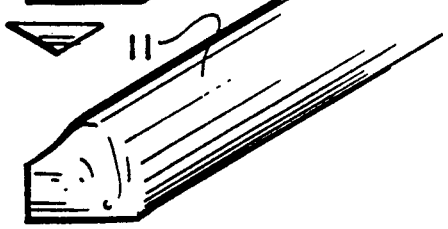

The tent is assembled by joining the tubes 11–21 together in one of two ways. The vertical tubes 11, 12, 14 and 21 are joined together by mitering the upper ends of the tubes in the manner shown in FIGS. 2–2C, inclusive. The mitered ends are sewn together to form a single joined unit, as is shown in FIGS. 3 and 4.

Figure 6:
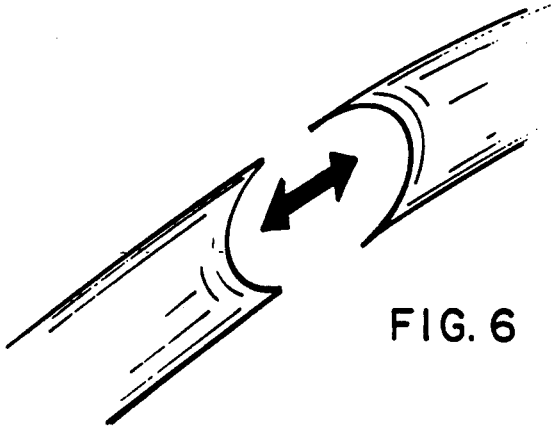
FIGS. 6 and 7 illustrate joinder of a vertical and horizontal tube an intersection of the two.
Figure 7:
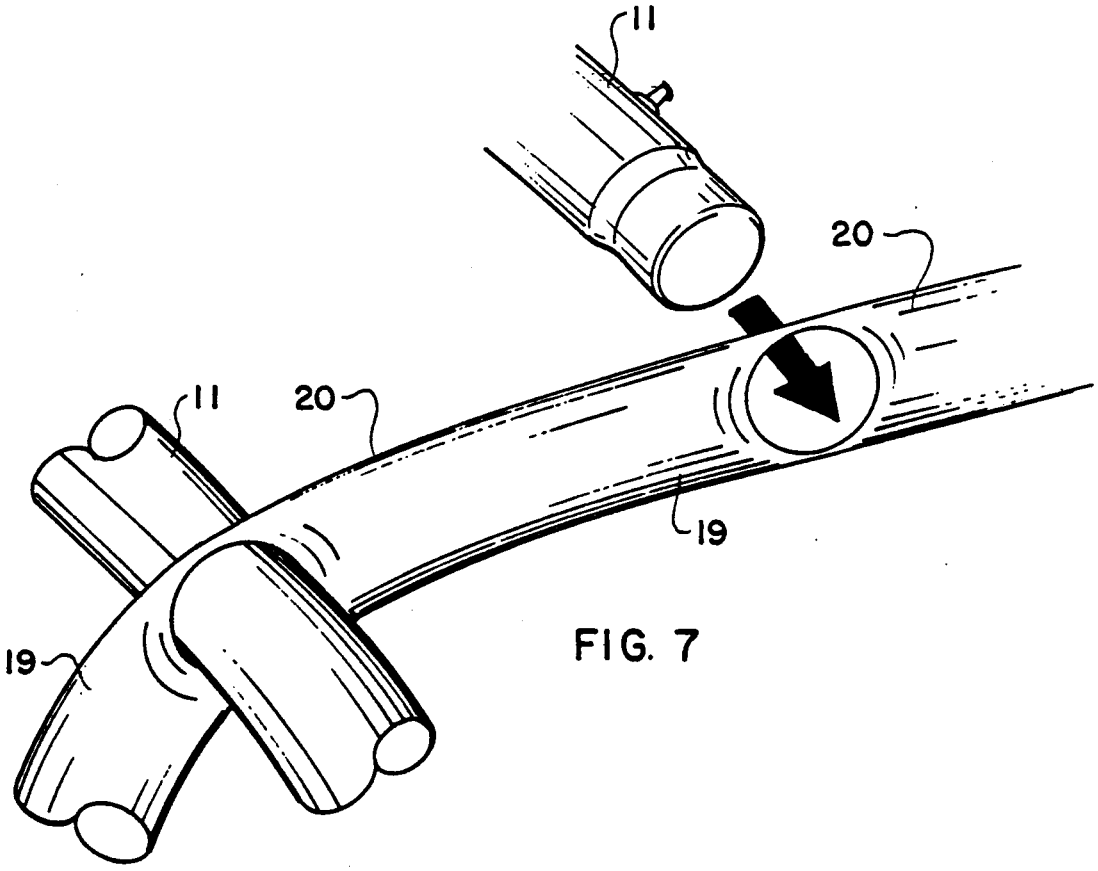

The horizontal and diagonal tubes are joined together as is shown in FIGS. 5–5C, by cutting a half-circle out of the end of each tube, and then sewing or otherwise joining together the outermost ends as is shown in FIGS. 6 and 7 to form a substantially circular void through one of the vertical tubes is extended. This permits all of the tubes to lie in the same plane.

Alternatively, all of the tubes can be terminated at each end so that a length of the tube between adjacent tubes comprises a separate, distinct pneumatic unit.

Figure 8:
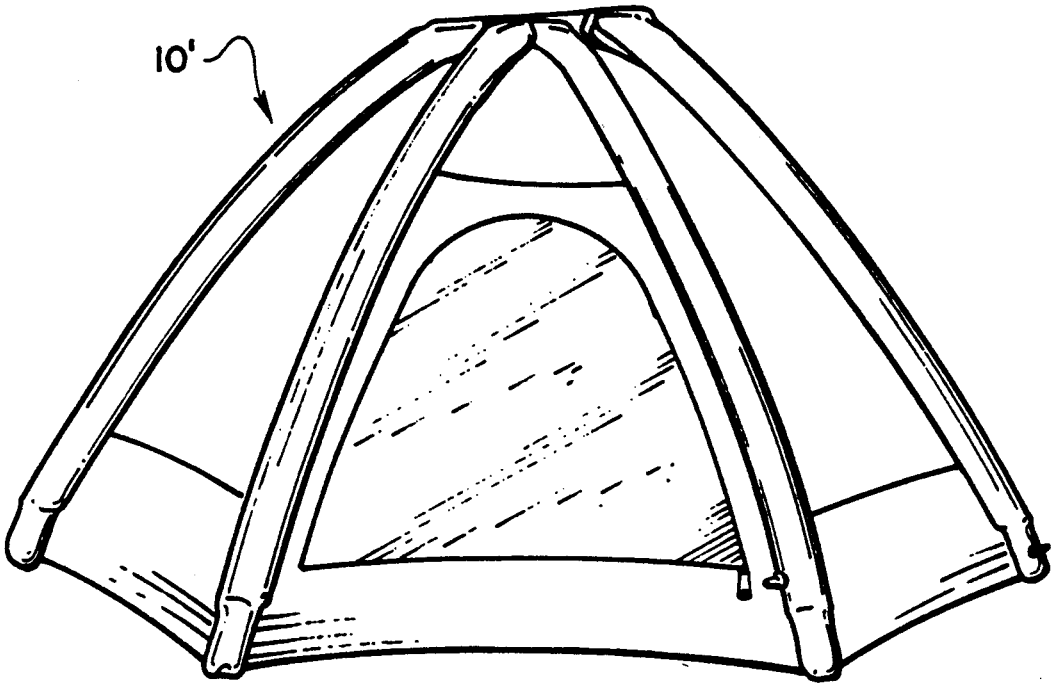
FIG. 8 is a perspective view of a tent according to another embodiment of the invention.

FIG. 8 illustrates a tent 10′ constructed substantially like that in FIG. 1, but without horizontal tubes and having six instead of four vertical tubes.

Figure 9:
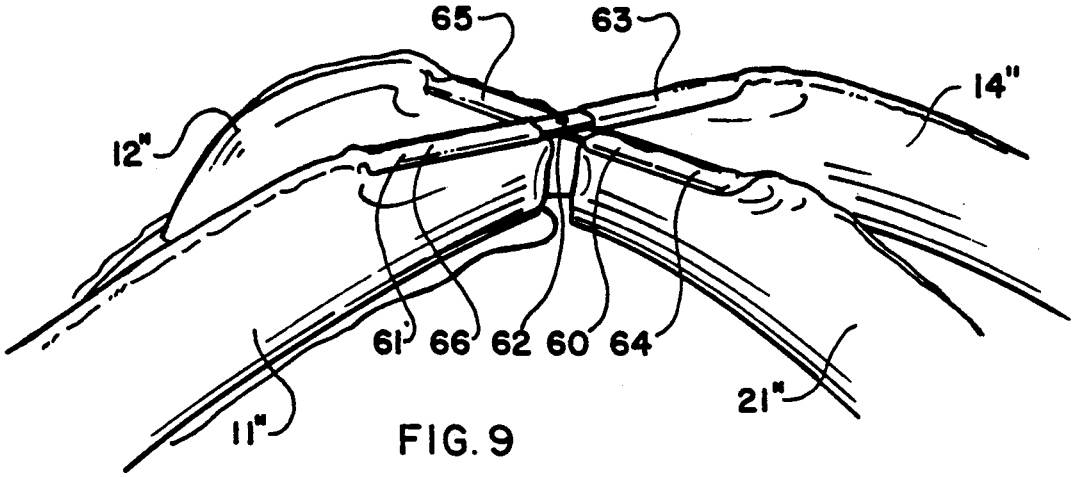
FIG. 9 is a fragmentary perspective view of the apex of a tent still another embodiment of the invention.

Two other ways of joining the vertical tubes together at the apex of tents 10″ and 100 are shown in FIGS. 9 and 10.

In FIG. 9, the vertical tubes 11″, 12″, 14″, 21″ are connected together by two crossed bars 60, 61 are joined at the center by a rivet 62. Elongated pockets 63, 64, 65 and 66 in the vertical tubes received opposed ends of the bars 60 and 61. The bars 60, 61 are secured in the pockets 63, 64, 65, 66 by rivets or by some other suitable attachment means, or can be held in simply by making the pockets so tight that surface friction retains the bars in the pockets. The bars 60, 61 are preferably made of a tough, durable ultraviolet treates plastic material the same color as the tent fabric.

Referring now to FIG. 10, tent 100 has six vertical tubes 101–106, inclusive which connected together by a frame comprised of three plastic bars 110–112 attached together by rivets 113–115. Each bar is twisted 90 on opposite ends, with the opposite ends extending into elongate pockets 120–125, as shown. The plastic bars 110–112 can be secured in the pockets 120–125 by rivets, or by other suitable means.

The structure described above can be fabricated in many other different shapes and sizes.

Ordinarily, about 6 pounds per square inch of air is sufficient to properly inflate the tents 10, 10′, 10″ and 100. This permits the inflation to carried out manually by means of a foot operated pump.

A tent according to several embodiments is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An inflatable tent structure, comprising:

(a) a plurality of mechanically interconnected but pneumatically separate, elongate inflatable tubes defining the perimeter of the tent structure for being separately inflated;

(b) a plurality of valves pneumatically connected to respective separately-inflatable tube for inflating the tubes;

(b) a plurality of wall panels suspended from and between the tubes to define the enclosure of the tent whereby the tubes define a support structure exterior to the enclosure of the tent.

2. An inflatable tent structure according to claim 1, wherein said tubes define a dome-shaped structure having an apex, said tubes converging in mechanical interconnection with each other in a single plane at the apex of the dome-shaped structure.

3. An inflatable tent structure according to claim 2, wherein at least some of said tubes have through passages therein, and other of said tubes extend through said tubes in the same plane as said tubes.

4. An inflatable tent structure according to claim 3, wherein said valves include connection means for interconnection with an air pump.

5. An inflatable tent structure according to claim 1, wherein said tubes include an interiorly projecting flange to which said wall panels are attached in spaced-apart relation.

6. An inflatable tent structure according to claim 5, wherein said flange is integrally formed from a material different from that which the tubes are formed by joining adjacent material together along a predetermined length and width thereof.

7. An inflatable tent structure according to claim 2, wherein said tent comprises a plurality of substantially vertically-extending tubes and a plurality of substantially horizontally-extending tubes mechanically intersecting said vertically-extending tubes in the same plane as said vertically-extending tubes.

8. An inflatable tent structure according to claim 2, wherein said tent comprises a plurality of substantially vertically-extending tubes and a plurality of substantially horizontally-extending tubes mechanically intersecting said vertically-extending tubes in the same plane as said vertically-extending tubes, wherein said vertically-extending tubes and said horizontally-extending tubes include separation means for pneumatically separating said tubes at each intersection.

9. An inflatable tent structure according to claim 8, and including mechanical attachment means for mechanically attaching said substantially vertically-extending tubes to each other at the apex of the tent.

10. An inflatable tent structure according to claim 9, wherein said mechanical attachment means comprises fabric attached by opposing edges to opposing vertically-extending tubes.

11. An inflatable tent structure according to claim 9, wherein said mechanical attachment means comprises elongate bars attached by opposing ends to opposing vertically-extending tubes.

12. An inflatable tent structure according to claim 11, wherein said bars comprise plastic.

* * * * *